United States Patent [19]

Honda et al.

[11] Patent Number: 4,851,623

[45] Date of Patent: Jul. 25, 1989

[54] PUSH-BUTTON SWITCH

[75] Inventors: Sueaki Honda, Kurayoshi; Mitsuji Hayashi, Nagaokakyo; Takashi Niwa; Akihiko Hayakawa, both of Kyoto; Hideyuki Bingo, Uji, all of Japan

[73] Assignee: Omron Tateisi Electronics Co., Kyoto, Japan

[21] Appl. No.: 57,434

[22] Filed: Jun. 2, 1987

Related U.S. Application Data

[63] Continuation of Ser. No. 803,581, Dec. 2, 1985, abandoned.

[30] Foreign Application Priority Data

| | | | |
|---|---|---|---|
| Dec. 5, 1984 | [JP] | Japan | 59-258172 |
| Dec. 10, 1984 | [JP] | Japan | 59-187722[U] |
| Dec. 26, 1984 | [JP] | Japan | 59-276820 |
| Dec. 28, 1984 | [JP] | Japan | 59-27650 |

[51] Int. Cl.[4] ..... H01H 9/00

[52] U.S. Cl. ..... 200/314; 200/467

[58] Field of Search ..... 200/314, 67 B

[56] References Cited

U.S. PATENT DOCUMENTS

| | | | |
|---|---|---|---|
| 3,867,596 | 2/1975 | Schadow | 200/314 |
| 4,346,275 | 8/1982 | Iwakiri et al. | 200/314 |
| 4,354,079 | 10/1982 | Yoshimura | 200/67 B |
| 4,398,075 | 8/1983 | Vogel | 200/314 |
| 4,585,914 | 4/1986 | Ohashi et al. | 200/314 |

FOREIGN PATENT DOCUMENTS 3146668 6/1983 Fed. Rep. of Germany .

*Primary Examiner*—Henry J. Recla
*Assistant Examiner*—Linda J. Sholl
*Attorney, Agent, or Firm*—Wegner & Bretschneider

[57] ABSTRACT

A push-button switch for turning on and off of a switch mechanism accommodated at one side in a housing through a plunger accommodated at the other side in the housing and moved in association with the pressure application thereto, wherein a partition wall is formed between said plunger and said switch mechanism so as to divide the interior of said housing into a plunger chamber and a switch mechanism chamber.

7 Claims, 8 Drawing Sheets

PUSH-BUTTON SWITCH

This application is a continuation of U.S. application Ser. No. 803,581, filed Dec. 2, 1985 now abandoned.

BACKGROUND OF THE INVENTION

1. Field of the Invention

The present invention relates to a push-button switch employed for turning on and off of various kinds of electronic appliances such as audio instruments, and more particularly, to a push-button switch of an illumination type which controls turning-on and -off of a switching mechanism accommodated within a switch body while it is fixedly inserted into a mounting socket and which has an illumination lamp provided therewithin for indication of the switch.

2. Description of the Prior Art

A push-button switch of the type referred to above has conventionally been known to be provided with a plunger at one side in a housing and a switching mechanism at the other side in the housing. This push-button switch controls the turning-on and -off of the switching mechanism through an alternate cam and the plunger moving in association with the pressure application thereto.

Meanwhile, it has been general that the sliding portions of the alternate cam and the plunger described above are applied with grease for the purpose of improving the sliding action and the service life thereof.

However, it has been a problem that the grease applied to the sliding portions may percolate the part of the switching mechanism, resulting in an inferior connection between contact points or reduction of connection reliability.

Therefore, in order to solve the above-described problem, the alternate cam and the plunger described above have been generally made of fluorine compound resin. However, this kind of resin is limited in its usage and therefore small in production amount. Moreover, the material for the resin is expensive, and therefore, the push-button switch made of this resin becomes unfavorably high in the manufacturing cost thereof, and is disadvantageous because of shorter service life, in comparison with one applied with grease.

Further, there has conventionally been known such a push-button switch as referred to above that is provided with a switch mechanism having the construction as follows. That is, one end of an operating member of a generally W-shape is engaged at a corner of a fixed terminal in inverted L-shaped configuration, and at the same time, a tension spring is stretched between the fixed terminal and a movable member such that the spring force of the tension spring is added to the operating member through the movable member. The other end of the operating member is moved in association with the depression of the plunger. Accordingly, when the plunger is depressed, a contact point formed at the free end of the movable member is brought into pressed contact with another fixed terminal opposed to the contact point.

However, the above-described switch mechanism is so small that it should be assembled by hand with the help of a pincette. Moreover, since the movable member is inevitably biased by the spring force of the tension spring during the assembling of the switch mechanism, there is a possibility that the operating member and the movable member be separated away from each other by the spring force, if the switch mechanism is not skillfully assembled.

Additionally, the above described inverted L-shaped fixed terminal has only its bottom end portion supported by a base, without any support means for its upper end portion. Therefore, when the fixed terminal is biased by the spring force of the above tension spring, particularly during the assembling time of the switch mechanism and the life cycle, the upper end portion of the fixed terminal may possibly be slipped or displaced, resulting in the change of the spring load of the tension spring which will be a cause for an unstable switching operation.

Furthermore, the prior art push-button switch is provided with a switch mechanism wherein a tension spring is stretched between the fixed terminal and the movable member such that the operating member is biased through the movable member by the spring force of the tension spring, while the other end of the operating member is moved in association with the depression of the plunger such that a coil spring provided with the plunger is compressed at the depression of the plunger, thereby to displace the operating member so as to bring a contact point formed at the free end of the movable member into pressed contact with another fixed terminal opposed to the contact point. In the prior art push-button switch having the switch mechanism as described above, the returning position of the switch has been determined by the balance between the coil spring and the tension spring. However, it is disadvantageous that the returning position of the operating member may undesirably be changed each time or the returning action may be hampered due to the unevenness found in the spring load of the coil spring and the tension spring, and the reduction of the spring force.

In the meantime, it has been impossible that the push-button switch of this illumination type is used as an indication lamp because each component part has a different structure. On the other hand, in the case that an indication lamp is to be added to an apparatus equipped with the push-button switch, more space is required for the indication lamp only. Moreover, in this case, an erroneous switching operation may be given rise to. For preventing such an erroneous switching operation, a special component part therefor becomes necessary, thereby enlarging the size of the switch. It is also disadvantageous that the total number of component parts is increased thereby to raise the cost for management of the switch.

SUMMARY OF THE INVENTION

Accordingly, an essential object of the present invention is to provide an improved push-button switch which is so designed as to prevent the grease applied to the sliding portions from percolating the part of a switch mechanism such that inferior connection between contact points is never given rise to or the connection reliability is never reduced, with stable and long service life being obtained.

A second object of the present invention is to provide an improved push-button switch of the type referred to above of which switch mechanism can be smoothly assembled, without separation between an operating member, a tension spring and a movable member, thus improving the assembling efficiency.

A third object of the present invention is to provide an improved push-button switch of the type referred to above which can prevent the upper end of a fixed terminal in an inverted L-shaped configuration from being displaced or deformed, and which can always maintain the spring load of the tension spring constant, thereby enabling stable switching operation.

A fourth object of the present invention is to provide an improved push-button switch of the type referred to above which can prevent the operating member from being returned at a different position other than a predetermined stroke position, without any change in the switching operation point.

A fifth object of the present invention is to provide an improved push-button switch of the type referred to above which can be used as an indication lamp only by changing a light emitting element.

A sixth object of the present invention is to provide an improved push-button switch of the type referred to above which, taking note of directional characteristic in the field of light projected by the light emitting diode, can illuminate at all times with constant brightness and without unevenness of brightness wherever a push-button is positioned, by the utilization of a light from the side face of the light emitting diode which has not been used before since it has been shielded by a lamp holder.

A seventh object of the present invention is to provide an improved push-button switch of the type referred to above which is reduced in the total number of component parts such that the assembling thereof is rendered easy and the size thereof is made stable, thereby reducing the manufacturing cost.

An eighth object of the present invention is to provide an improved push-button switch of the type referred to above which is so arranged as to satisfy both the resiliency of the movable contact member and the strength of the fixed terminal by making large the moving radius of the movable contact member through utilization of a grooved portion formed in a switch base although the movable contact member and the fixed contact point are integral in a foot terminal for external connection.

A ninth object of the present invention is to provide an improved push-button switch of the type referred to above which can be easily and securely inserted into a socket in the correct state even when the insertion is difficult, thereby protecting apparatuses connected thereto from any possible damage or erroneous operation.

In accomplishing these and other objects, according to the present invention, a push-button switch includes a partition wall formed between a plunger which is moved in association with the pressure application to the switch and a switch mechanism which is controlled to be turned on or off by the plunger. Since the partition wall divides the interior of the housing into a plunger chamber and a switch mechanism chamber, the grease applied to the sliding portions of the plunger is prevented from invading into the neighborhood of the switch mechanism. As a result, even in the case that the amount of the grease is more or less excessive or the grease is applied to a slightly different position, it never takes place that the grease invades into the neighborhood of the switch mechanism. Moreover, it is needless to say that not only the operation for application of the grease becomes simplified, but any possible inferior connection between contact points and any possible reduction in connection reliability which would be brought about by the invasion of the grease into the switch mechanism can be avoided, with a stable long service life being ensured.

Further, the push-button switch of an illumination type of the present invention is formed with an insertion part for an illuminator on the top surface of the base, and a groove for insertion of a terminal to be connected to the illuminator at the side face of the base. Therefore, the terminal is assembled with ease and with stabilized size. Moreover, it is advantageous that the insulation distance is easily secured, and the total number of component parts is reduced to minimize the manufacturing cost of the switch.

In addition to the partition wall described above for separating the switch mechanism from the plunger, the push-button switch according to the present invention has a through-hole formed on the partition wall, through which the operating member is led out to the side of the plunger. This through-hole has an engagement portion so as to bring the operating member into engagement with the edge thereof during the time of temporary assembling. Therefore, while the switch mechanism is assembled, the operating member biased by the tension spring can be engaged at the above engagement portion, and accordingly, each component part constituting the switch mechanism, namely, the operating member, the tension spring and the movable member can be always properly assembled, without separating from each other, thus improving the efficiency of assembling operation.

In the push-button switch of the present invention, the movable member to be engaged with the operating member has a U-shaped notch formed therein such that two engagement plates are made integral. These engagement plates have respectively an engagement recess opposed to each other at the inner periphery thereof, which engagement recesses are engaged with the outer edge of the operating member. Accordingly, while the switch mechanism is assembled, the operating member can be coupled with the movable member. Therefore, even when the tension spring is biased to the movable member, the engagement between the movable member and the operating member is never missed. It is therefore convenient that the assembling of the switch mechanism can be carried out without any separation between the movable member and the operating member, thereby improving the efficiency of the assembling operation.

Still further, the push-button switch of the present invention includes a lateral frame integrally formed on the base, to which the top end of the inverted L-shaped fixed terminal is engaged. Owing to the engagement of the top end of the fixed terminal with the lateral frame, even when the fixed terminal is biased by the tensile of the tension spring, it is prevented by the lateral frame that the top end of the fixed terminal is displaced or deformed. Thus, the spring load of the tension spring is maintained constant at all times, guaranteeing a stable switching operation for a long period of service life.

According to the push-button switch of the present invention, the plunger is integrally formed with a compulsory returning member which comes into contact with the operating member at the position of a predetermined stroke. During the returning process of the plunger, when the plunger is returned to a predetermined position, the compulsory returning member integral with the plunger is brought into contact with the operating member which is in turn forcibly returned into the normal state, and therefore, the operating member is securely prevented from returning at a different position than the predetermined position or from improperly returning to the predetermined position. Moreover, the operating member can be returned, without failure, at the position of the predetermined stroke, thereby effecting stabilization of the switch operating point for a long service life.

Within the housing of the push-button switch, a lamp casing is so held as to be able to be moved upwardly and downwardly. At the same time, a light emitting element facing the inside of the lamp casing is so arranged as to selectively represent a first configuration permitting the upward and downward movement of the lamp casing and a second configuration obstructing the upward and downward movement of the lamp casing through engagement thereof with the lamp casing. In the arrangement as described above, an indication lamp can be easily constituted only by changing the light emitting element, which indication lamp can be obtained with the switching part still mounted on the apparatus. Further, any possible erroneous operation can be avoided, and the attachment and the detachment of the light emitting element to and from the lamp casing can be easily performed, at reduced cost of component parts which may be commonly used for all the series of the switches.

A lamp holder for pivotally supporting the light emitting diode at the axial center of a reflecting mirror is made of transparent material. It is so arranged that, subsequent to the sliding movement of the reflecting mirror upon pushing of the push-button, the lamp holder is projected relatively into the inside of the reflecting mirror to be exposed. Thus, according to the present invention, since the lamp holder is projected into the interior of the reflecting mirror in accordance with the sliding movement of the reflecting mirror, the light from the side face of the light emitting diode, after passing through the lamp holder, is reflected by the reflecting mirror to be added to the light from the tip end of the light emitting diode. Therefore, the effective reflecting area of the reflecting mirror reduced due to the pressure application to the push-button, that is, the reflecting light amount reduced thereby can be compensated. Further, the brightness on the illumination face is uniform when the push-button is depressed, or the brightness is hardly changed irrespective of the position of the push-button, namely, whenever the push-button is in the free position or in the depressed position. An improved contrast can be obtained, without any unevenness of the brightness generated in the depressed position of the push-button. Moreover, the illumination part can be made compact in space, thereby minimizing the push-button switch itself.

A foot terminal for external connection for the indication lamp is so constructed into an integral foot terminal that the inner end thereof is a movable contact piece to be electrically connected to the indication lamp, while the outer tip thereof is a fixed terminal. Simultaneously with this, a grooved portion forming a gap in the circumference of the base part of the movable contact piece is sunk at the portion where the foot terminal penetrates the switch base. Accordingly, the center of the movement of the movable contact piece is rendered nearer to the side of the fixed terminal by the degree with which the grooved portion is sunk, thereby increasing the radius of the movement of the movable contact piece. Therefore, even when the movable contact piece and the fixed terminal are made into an integral metal foot terminal, which foot terminal is arranged to have such a thickness as to properly maintain the strength of insertion of the fixed terminal into the socket, the resilient deformation force of the movable contact piece becomes so sufficient that either the movable contact piece, or the fixed terminal is not de-functioned.

At the side face of the switch body is formed a projection corresponding to the positioning engagement recess provided on the inner peripheral surface of the switch insertion part of the socket. According to the present invention, the switch body is constructed in the manner that the relative relationship between the foot terminal and the projection is determined beforehand so that when the projection at the switch body is engaged with the engagement recess at the side of the socket, the switch body is properly inserted into the socket, and accordingly the inserting operation will be effectively carried out, without failure, thereby achieving the above-described objects of the present invention.

BRIEF DESCRIPTION OF THE DRAWINGS

These and other objects and features of the present invention will become apparent from the following description taken in conjunction with preferred embodiments thereof with reference to the accompanying drawings, in which.

DESCRIPTION OF THE EMBODIMENTS

Figure 1:
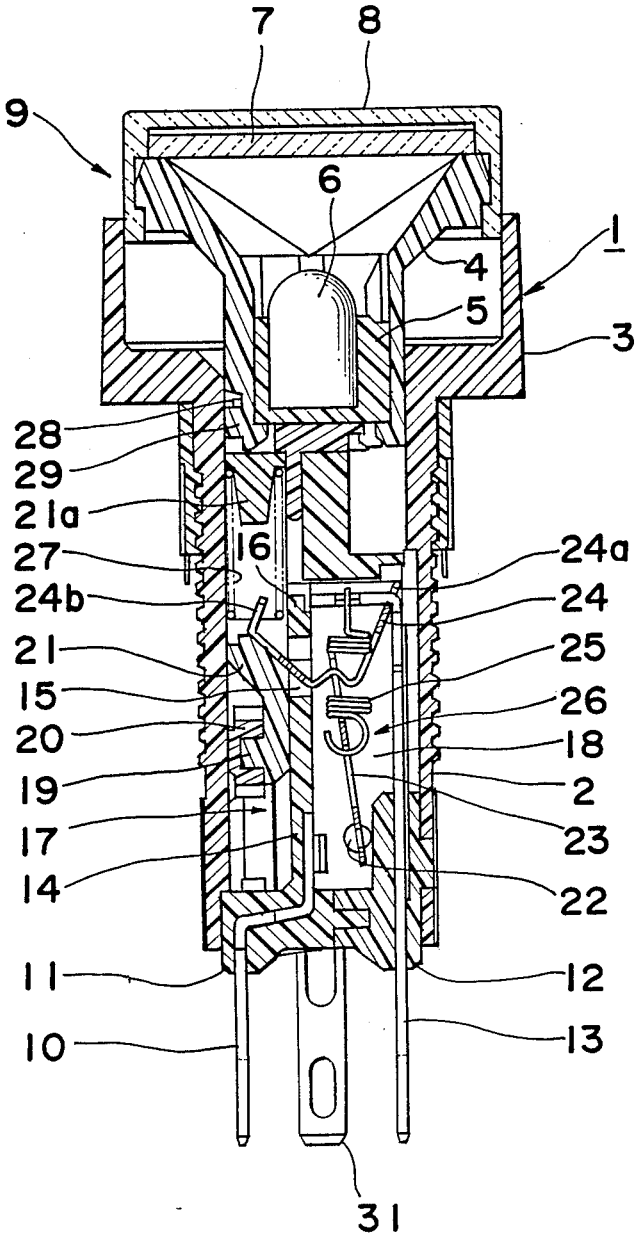
FIG. 1 is a cross sectional view of a push-button switch according to the present invention.

Before the description of the preferred embodiments of the present invention proceeds, it is to be noted here that like parts are designated by like reference numerals throughout the accompanying drawings.

Figure 2B:
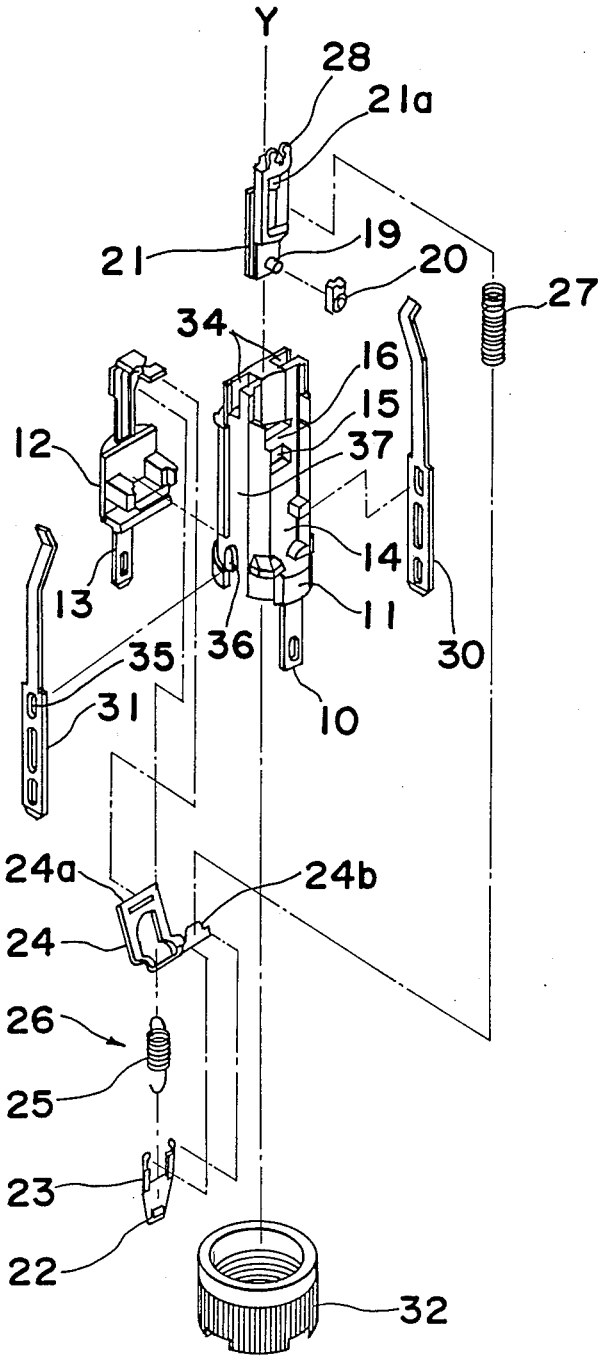
FIG. 2 is an exploded perspective view of the switch of FIG. 1.
Figure 2A:
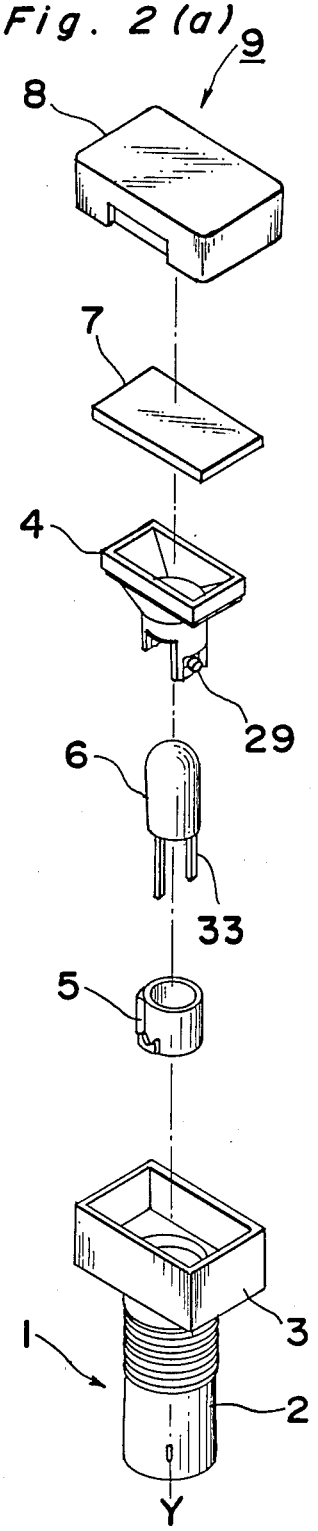

Referring now to the drawings, there is shown in FIGS. 1 and 2 a push-button switch of an illumination type according to the present invention. A housing 1 made of synthetic resin is composed of a lower part 2 in cylindrical configuration and an upper part 3 in square hollow configuration. The cylindrical part 2 is integrally formed with the square hollow part 3.

A light emitting diode 6 held by a holder 5 is placed at the lower part of a lamp casing 4 made of synthetic resin, while a covering 8 is fitted into the upper part of the casing 4 through a light diffusion disk 7.

It is to be noted that the LED 6 is one example of an illuminator, and it may be a lamp.

All of the above component parts 4 through 8 are formed into one unit 9 which is slidably mounted at an opening mouth at the top end of the housing 1.

In the meantime, there are accommodated in the cylindrical part 2 a first base 11 integrally formed with a terminal 10 and a second base 12 integrally formed with a fixed terminal 13 in an inverted L-shaped configuration.

The first base 11 has a partition wall 14 erected approximately at the center of the cylindrical part 2 so as to divide a switch mechanism 26. This partition wall 14 is formed with a through-hole 15 for leading out an operating member 24, which will be described later, to the side of a plunger 21, and at the same time, integrally formed with a lateral frame 16 next to the through-hole 15 by the use of synthetic resin. An upper end 13*a* of the fixed terminal 13 is engaged with a notched portion 16*a* in an L-shaped configuration of the frame 16.

Furthermore, the first base 11 is formed with grooves 37 at the opposite sides thereof such that the LED terminal 31 is fitted in the groove 37. Moreover, the first base 11 has an insertion part 34 at the opposite sides on the top surface. While an aperture 35 formed on the LED terminal 31 is fitted into a projection 36 formed in the grooves 37, the LED terminal 31 is inserted into the insertion part 34 and then fitted into the cylindrical part 2. Leading terminals 33 of light emitting diode 6 are inserted into insertion part 34 to thereby contact LED terminals 30 and 31.

The partition wall 14 divides the interior of the cylindrical part 2 into a plunger chamber 17 and a switch mechanism chamber 18. In the plunger chamber 17, there is provided a plunger 21 slidably mounting an alternate cam 20 on a projected shaft 19. On the other hand, in the switch mechanism chamber 18, there is placed a switch mechanism 26 which is composed of a movable member 23 having a contact point 22 formed at the free end portion thereof, an operating member 24 generally in W-shaped configuration, and a coil spring 25.

In other words, the partition wall 14 is formed between the plunger 21 and the switch mechanism 26.

Figure 3:
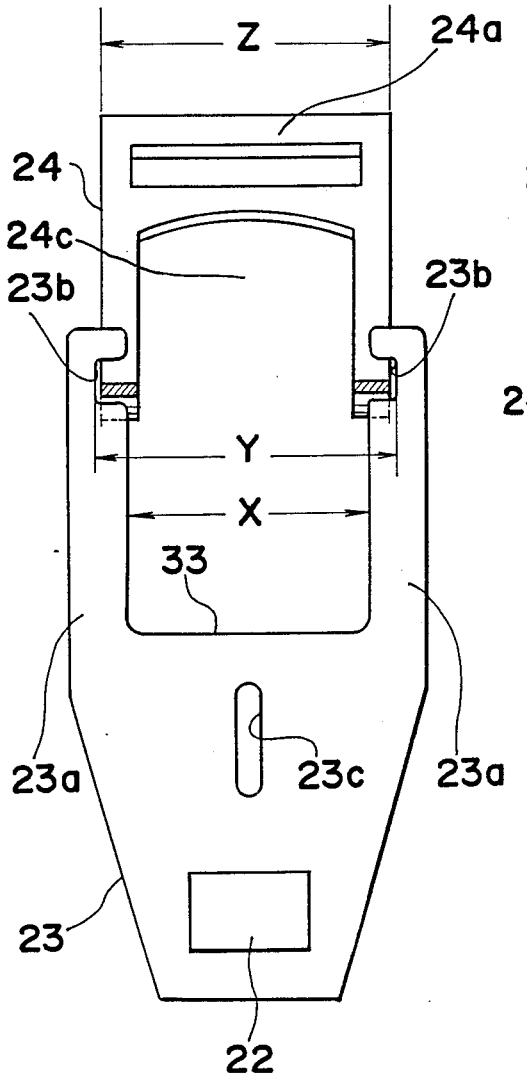
FIG. 3 is a view showing an essential portion of the switch on an enlarged scale.
Figure 4:
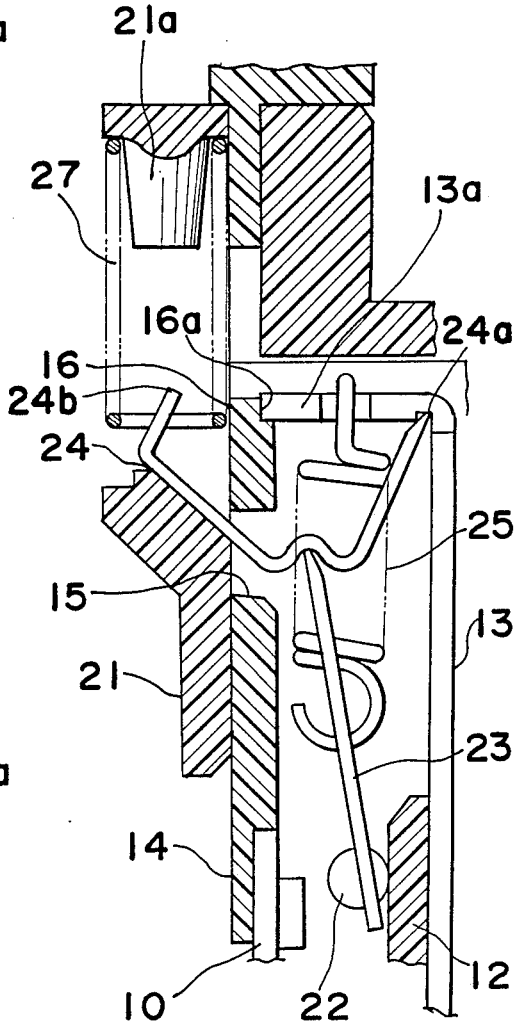
FIGS. 4 to 7 are cross sectional views of an essential portion of the switch, on an enlarged scale, respectively explanatory of the returning operation.

As shown in FIG. 3, the movable member 23 has two engagement plates 23*a* and 23*a* integrally formed therewith by a U-shaped notch 33 extending from the upper end towards the center thereof.

These engagement plates 23*a* and 23*a* are respectively formed at the inner peripheral surface thereof with engagement recesses 23*b* and 23*b* opposed to each other. The engagement recesses 23*b* and 23*b* are engaged with the external edge of the operating member 24.

Supposing that the distance between the inner faces of the engagement plates 23*a* and 23*a* is X, the distance between the outermost faces of the engagement recesses 23*b* and 23*b* is Y, and the distance between the outer edges of the operating member 24 is Z, it is so arranged that an inequality $X<Z<Y$ is established.

One end 24*a* of the operating member 24 of generally W-shaped configuration is engaged with the inverted L-shaped terminal 13, and the engagement recesses 23*b* and 23*b* are engaged with the operating member 24 at the outer edge of the central part thereof, such that the operating member 24 is linked with the movable member 23. Then, a tension spring 25 which has its upper end hooked by the engagement portion 13*a* of the terminal 13 is passed through a central hole 24*c* of the operating member 24 out downwards. The lower end of the tension spring 25 is hooked by a spring engagement hole 23*c* of the movable member 23. End 24*a* is engaged with inverted L-shaped terminal 13. The central portion of operating member 24 passes through the through-hole 15 such that the other end 24*b* of operating member 24 is located in plunger chamber 17. Between the other end 24*b* of the operating member 24 and a spring seat 21*a* above the plunger 21 is stretched a coil spring 27.

Moreover, an engagement corner 28 at the upper end of the plunger 21 is engaged with a projected shaft 29 below the lamp casing 4, and accordingly, the plunger 21 is moved in association with the pressing operation of the unit 9.

It is to be noted here that numerals 30 and 31 represent terminals for LED, and a numeral 32 represents a screw to be meshed with a screwing part in the outer periphery of the cylindrical part 2.

The push-button switch according to the present embodiment having the construction a described hereinabove will operate as follows.

When the unit 9 is pressed down, the plunger 21 is moved downward owing to the engagement between the engagement corner 28 and the projected shaft 29. This downward movement of the plunger 21 is transmitted through the coil spring 27 to the operating member 24 which in turn swings in the counterclockwise direction in FIG. 1, with the one end 24*a* being a fixed point. At the same time, the alternate cam 20 is rotated half, maintaining the downward movement of the plunger 21. Cam 20 is supported by and rotates around shaft 19, with said shaft 19 being attached to plunger 21. Each time unit 9 is pushed downward, cam 20 rotates a quarter turn. Cam 20 is shaped such that with a first push of unit 9, plunger 21 is locked in a lowered position. When unit 9 is pushed a second time, cam 20 rotates to unlock plunger 21 such that plunger 21 moves upward under the force of spring 27.

Figure 5:
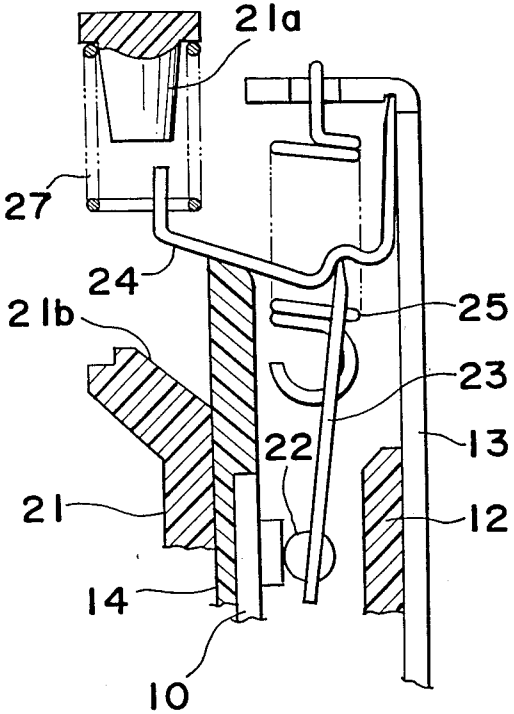

As a result, as shown in FIG. 5, the movable member 23 engaged with the tension spring 25 is inclined so as to press the contact point 22 against the terminal 10 opposite to the contact point 22. Thus, the push-button switch is turned from the off state to the on state, and the LED 6 starts to emit light. This condition is maintained by the alternate cam 20.

Figure 7:
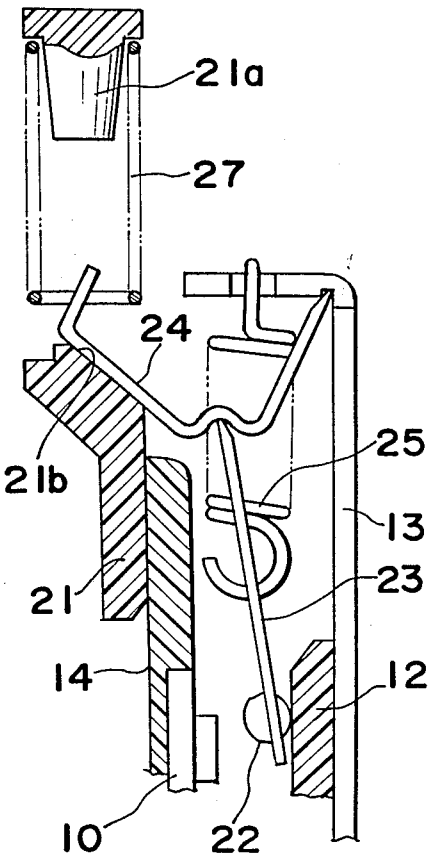

When the plunger 21 is to be returned from the depressed position shown in FIG. 5 to upwards by moving the unit 9 again, the plunger 21 is returned by the spring force of the tension spring 25 and the coil spring 27. When the plunger 21 is returned by a predetermined stroke from the position shown in FIG. 5 to the position shown in FIG. 6, a compulsory returning member 21*b* of a tapered configuration and integral with the plunger 21 is brought into contact against the bottom face of the operating member 24 which is in turn forcibly displaced so as to be brought into the condition shown in FIG. 7 from the condition of FIG. 6, with the movable member 23 being inclined to turn off the switch.

Figure 6:
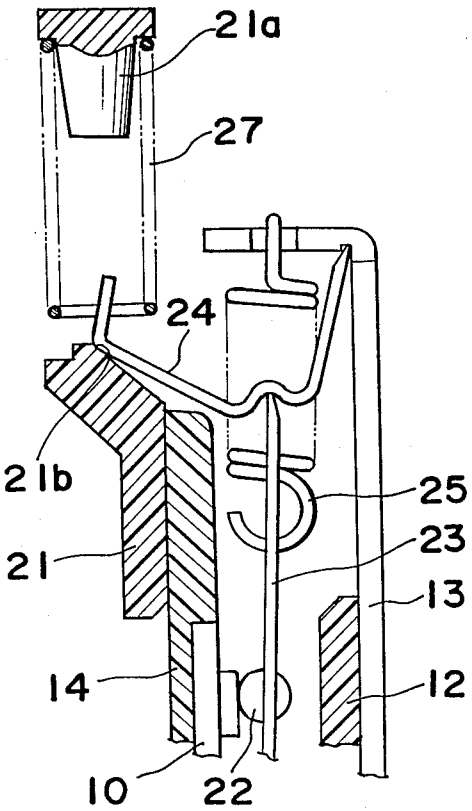

In the manner as described hereinabove, since the compulsory returning member 21*b*, which is integrally formed with the plunger 21, forcibly moves the operating member 24 when the plunger is returned to the predetermined position shown FIG. 6, the operating member 24 can be prevented from returning to a different position other than the predetermined position or improperly returning to the predetermined position.

Therefore, it is advantageous that the operating member 24 can be securely returned at a predetermined stroke position.

Under the circumstances as described above, when the unit 9 is depressed again, the push-button switch is turned off and again assumes the configuration shown in FIG. 1.

Figure 8B:
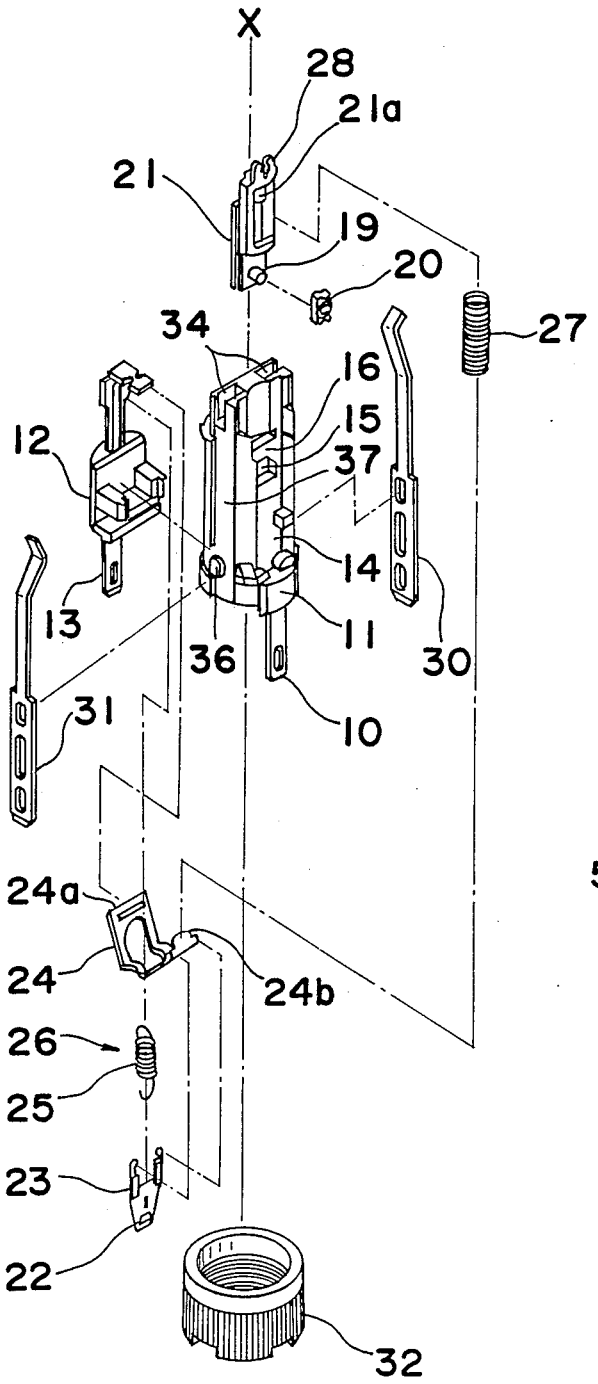
FIG. 8 is an exploded perspective view of a push-button switch of an illumination type according to another embodiment of the present invention.
Figure 8A:
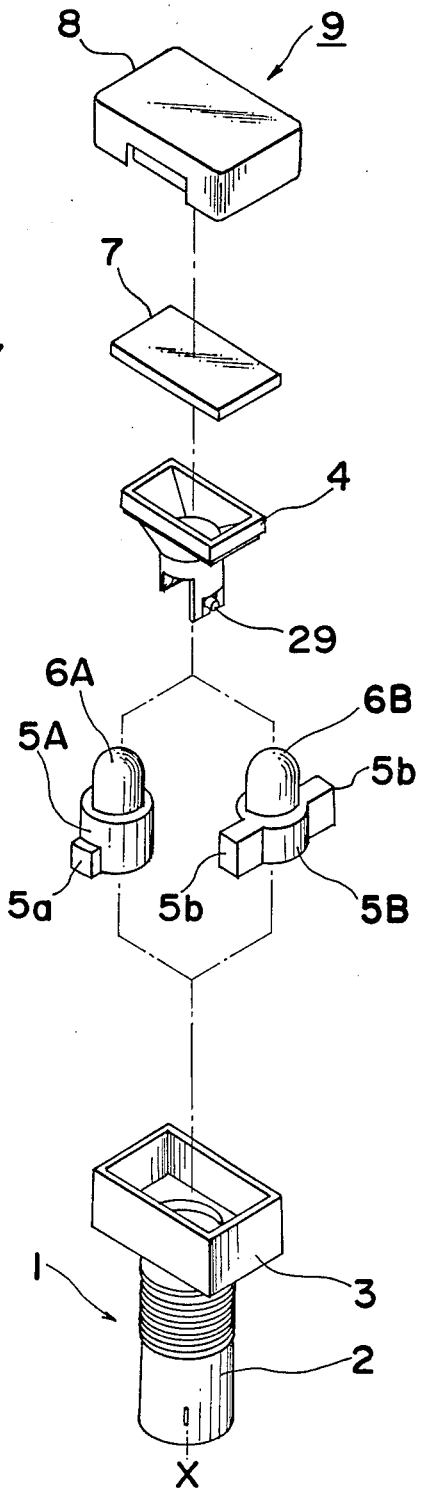

FIG. 8(*a*) shows a modified embodiment of the holder 5 and the light emitting element 6 of FIG. 2. Referring to FIG. 8(*a*), the lamp casing 4 made of synthetic resin selectively includes a light emitting element 6A held by a holder 5A provided therebelow or a light emitting element 6B supported by a holder 5B provided therebelow, and, a covering 8 fitted thereabove through the light diffusion disk 7.

The unit 9 which is formed through integral formation of the component parts 4 through 8 is slidably mounted on the top opening mouth of the housing 1.

Figure 9:
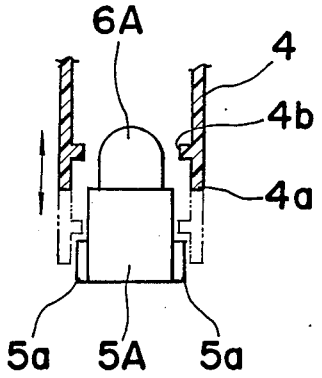
FIG. 9 is a view explanatory of a light emitting element for switch.

The holder 5A of the light emitting element 6A is, as shown in FIG. 9, provided with small projections 5*a* at opposite sides of the lower part thereof. It is so arranged that, when the lamp casing 4 is moved downwards, the projections 5*a* are brought within the peripheral wall 4*a* of the casing 4 such that the projections 5*a* are able to be in contact with inner projections 4*b*, thereby undesirable separation from the projections 4*b* being prevented.

Figure 10:
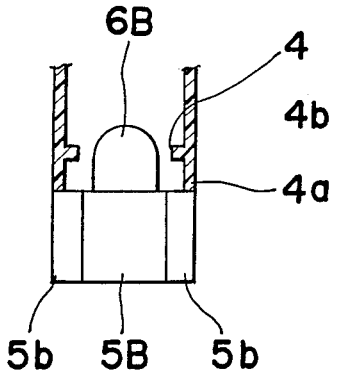
FIG. 10 is a view explanatory of a light emitting element for an indication lamp.

On the other hand, the holder 5B of the light emitting element 6B is, as shown in FIG. 10, provided with projections 5*b* at the opposite sides thereof which are larger than the projections 5*a*, and which are brought into contact with the lower part of the peripheral wall 4*a* of the lamp casing 4 so as to avoid the downward movement of the lamp casing 4.

More specifically, either the light emitting element 6A having a first configuration shown in FIG. 9 to be used as a switch or the light emitting element 6B having a second configuration shown in FIG. 10 to be used as an indication lamp is selectively accommodated below the lamp casing 4.

Now, upon depression of the unit 9, the projected shaft 29 is engaged with the engagement corner 28 so as to move the plunger 21 downwards. This downward movement of the plunger 21 is transmitted to the operating member 24 through the coil spring 27, and accordingly the operating member 24 is swung in the counterclockwise direction of FIG. 1, with its one end 24*a* being a fixed point. Concurrently, the alternate cam 20 is rotated half, thereby maintaining the downward movement of the plunger 21.

In consequence, the movable member 23 engaged with another coil spring 25 is inclined such that the contact point 22 at the lower end thereof is brought in pressed contact against the opposite terminal 10, thereby switching the push-button switch from off to on. This state is maintained by the alternate cam 20, while the light emitting element 6A emits light.

Under the condition as described above, when the unit 9 is depressed again, the push-button switch is then turned from on to off, representing the state shown in FIG. 1.

With reference to FIGS. 9 and 10, in a first configuration where light emitting element 6A is used, the lamp casing 4 is so supported as to be able to move upwards and downwards within the housing 1. Light emitting element 6A has relatively narrow projections 5*a* which permit casing 4 to move up and down. In a second configuration, where light emitting element 6B is used, casing 4 is unable to move down because it is blocked by the relatively wide projections 5*b*. Accordingly, the light emitting element 6A for the switch in the first configuration can be exchanged with the light emitting element 6B for an indication lamp having the second configuration so as to constitute an indication lamp. Therefore, in the second configuration, the switch feature of the device is not used such that the device simply functions as an indication lamp. Moreover, in this case, the switch mechanism 26 can remain as it is accommodated within the housing 1. Furthermore, the switch mechanism 26 is accommodated individually in the housing 1, thereby avoiding any possible erroneous operation. It is further advantageous that the switch mechanism can be readily and easily accommodated in and separated from the lamp casing 4, requiring the holder 5 only as a special component part, thereby minimizing the manufacturing cost of components parts which can be made common for all the series of the switches.

Figure 11:
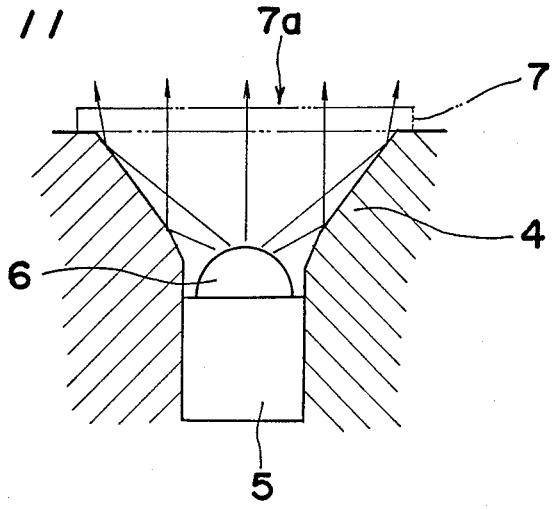
FIG. 11 is a structural view of a cross section of an illumination part in the free position.
Figure 12:
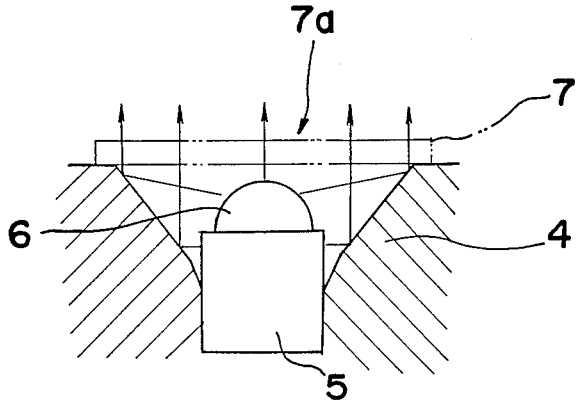
FIG. 12 is a structural view of a cross section of an illumination part in the depressed position.
Figure 13:
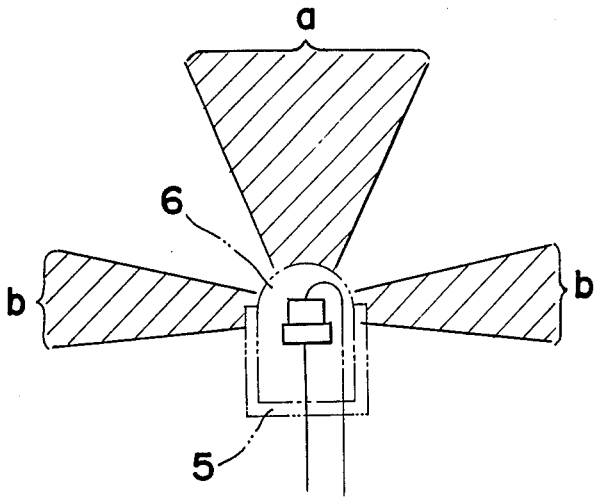
FIG. 13 is a view explanatory of directional characteristic of a light emitting element.

FIGS. 11 to 13 show a further modification of the holder 5 of FIG. 2.

Referring to FIGS. 11 and 12, the lamp holder 5 for holding the light emitting diode 6 (which holder may be integrally molded with the light emitting diode) is made of transparent material. When the push-button 8 is in the free position, the lamp holder 5 is shielded by the central portion of the reflecting mirror 4 as shown in FIG. 11. When the push-button 8 is pressed down and the reflecting mirror 4 slides downwardly, the lamp holder 5 protrudes into the inside of the reflecting mirror 4 as shown in FIG. 12. Thus, the light from the side face of the light emitting diode 6 passes through the transparent lamp holder 5 to be reflected by the reflecting mirror 4, increasing the light amount of the light emitting diode 6.

In other words, as is well known, the light emitting diode 6 is of directional characteristic in the field of the light emitted thereby. Although the field of the light emitted by the diode 6 is divided into the top end a and the side faces b of the diode 6 as shown in FIG. 13, in general use, only the light at the top end a is used for illumination, and the light at the side faces b of the diode 6 is shielded by the lamp holder supporting the diode 6, and therefore, is never used.

However, if the lamp holder 5 is made of transparent material as described above, and the light at the side faces b of the light emitting diode is arranged to be added to the light at the top end a of the diode when the push-button 7*a* is depressed, even when the effective reflecting area of the reflecting mirror 4 is reduced due to the depression of the push-button, that is, the light amount reflected at the top end a of the diode is reduced, it can be compensated by reflecting the light at the side faces b of the diode. Therefore, the illuminated face 7*a* is maintained even in the case that the push-button 8 is depressed as bright as when the push-button is in the free position. Moreover, the field of the light is made uniform as shown in FIG. 12, thereby such an illuminated face 7*a* that has no unevenness in brightness becoming possible.

Figure 14:
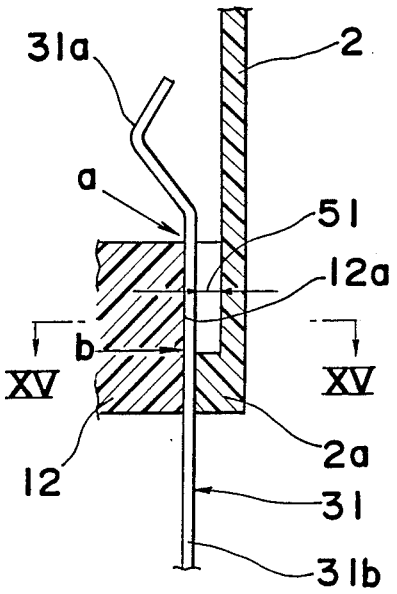
FIG. 14 is a cross sectional view of a mounting portion of a foot terminal for external connection.
Figure 15:
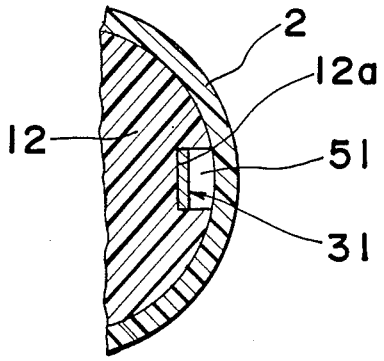
FIG. 15 is a cross sectional view taken along the line II—II of FIG. 14.

FIGS. 14 and 15 show a modification of a foot terminal for external connection of an illumination lamp.

In FIGS. 14 and 15, a foot terminal 31 for external connection to be used for an illumination lamp is integrally molded from metal plate, of which inner end is a movable contact piece 31*a* and of which outer end is a fixed terminal 31*b*. The thickness of the foot terminal 31 is determined in such a manner that the insertion strength of the fixed terminal 31*b* into the socket is maintained at an adequate pressure.

On the other hand, the switch 12 has a grooved portion 12*a* embedded in the direction the foot terminal 31 penetrates the switch and at the peripheral face portion of the base. The grooved portion 12*a* is more than twice as thick as the foot terminal 31. There is provided a projection 2*a* at the lower end portion of the casing 2. As the switch base 12 is fitted in the bottom portion of the casing 2 while the foot terminal 31 is fitted in the grooved portion 12*a*, the projection 2*a* is closely fitted into the lower half of the grooved portion 12*a*, with the foot terminal 31 being fixedly sandwiched between the base 12 and the switch casing 2, and a gap 51 being formed by the grooved portion 12*a* above the projection 51.

Although the foot terminal 31 has, in general, the center of movement for the movable contact piece 31*a* at a point a shown by an arrow where the foot terminal 31 penetrates above the switch base 12, according to the arrangement as above, the center of movement of the movable contact piece 31*a* is lowered to a point b shown by an arrow at the lowest portion of the gap 2*a*, because of the presence of the gap, thereby increasing the moving radius of the movable contact piece 31*a*. Accordingly, even when the movable contact piece 31*a* is as thick as the fixed terminal 31*b*, and is made relatively thick so as to maintain the strength of insertion of the fixed terminal 31*b* into the socket, the movable contact piece 31*a* is favorably and resiliently deformed. During the assembling of the switch body, a suitable electric connection can be established between the movable contact piece 31*a* and the illumination lamp 6. A suitable connection can be established by contacting contact piece 31*a* against a lead wire 33 that extends from lamp 6.

Figure 16:
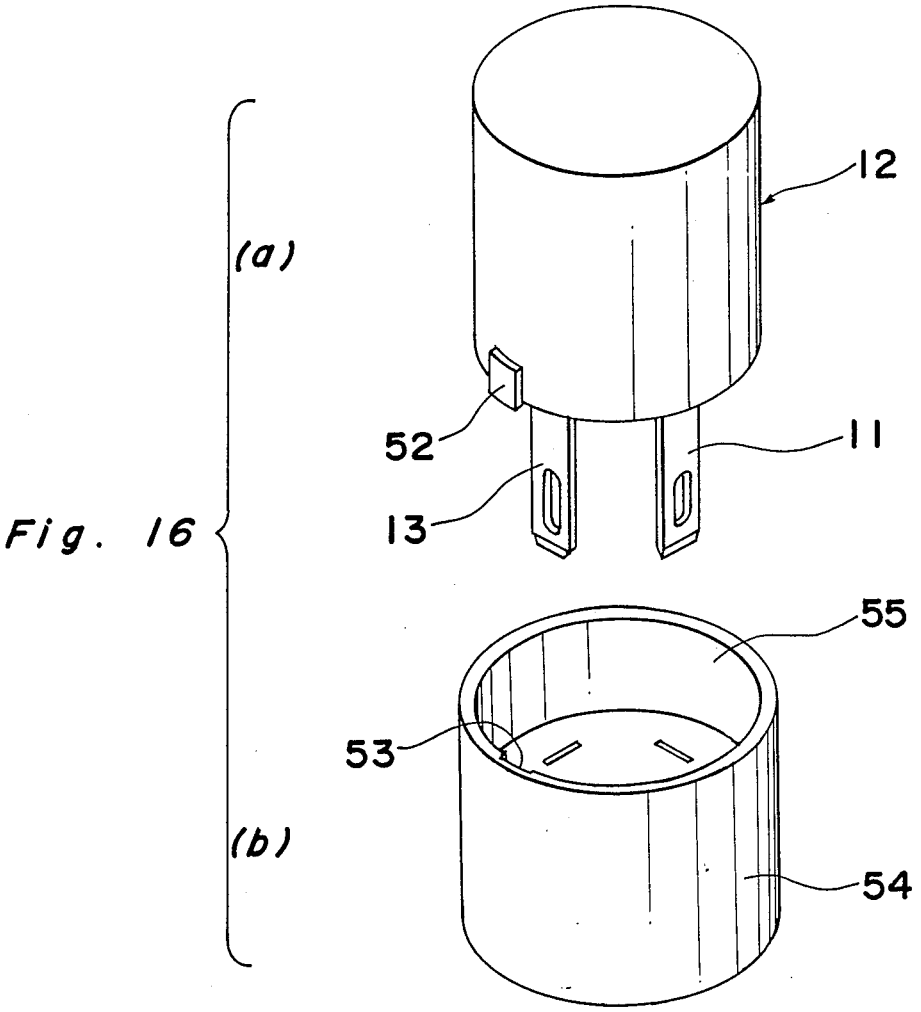
FIG. 16 is a perspective view of a switch body and a socket.

FIG. 16 shows a modification of the switch body casing 12.

In the drawing, an engagement recess 53 is formed in the direction of the insertion of the switch on the inner peripheral surface of a switch insertion part (hole) 55, and at the same time, a protrusion 52 is formed on a part of the outer peripheral surface of the switch body casing 12. When the switch body 12 is inserted into the socket 54 while the protrusion 52 is in engagement with the engagement recess 53, the switch body 12 should be formed through preliminary determination of the positional relationship between the protrusion 52 and the foot terminals 11 and 13 so that the switch body 12 is correctly inserted into the socket. Protrusion 52 inserts into engagement recess 53, thereby holding switch body 12 in socket 54.

Accordingly, the switch body 12 can be correctly inserted into the socket only by selecting the position of the engagement between the protrusion 52 of the switch body 12 and the engagement recess 53 of the socket 54. An electric conduction can be maintained while the contact point of the socket coincides with the contact point of the switch mechanism.

As is made clear from the foregoing embodiments, in the push-button switch of the present invention, since the partition wall 14 is erected between the plunger 21 and the switch mechanism 26, it is prevented by the partition wall 14 that the grease applied to the plunger 21 and the alternate cam 20 invades into the switch mechanism chamber 18 which would be given rise to due to the sliding movement of the plunger 21 and the alternate cam 20, thereby to avoid any possible inferior connection or reduction in connection reliability, with securing long service life. Moreover, during the assembling time of the above push-button switch, one end of the operating member 24 of a generally W-configuration is brought into engagement with the inverted L-shaped terminal 13, and at the same time, the tension spring 25 is stretched between the terminal 13 and the movable member 23, which movable member 23 is in turn communicated to the intermediate portion of the operating member 24 so as to transmit the spring force of the tension spring 25 to the operating member 24. Therefore, when the operating member 24 is led out to the side of the plunger 21 through the through-hole 15, the operating member 24 is engaged with the engagement portion 16 at the edge of the through-hole 15, and therefore the operating member 24, the tension spring 25 and the movable member 23 can be smoothly assembled, without experiencing any undesirable separation therebetween. Thus, it is highly effective to improve the assembling efficiency.

Moreover, the fixed terminal 13 has its top end 13*a* engaged with the L-shaped notched portion 16*a* of the lateral frame 16 such that the top end of the fixed terminal 13 can be prevented from slipping downwards by the lateral frame 16.

Therefore, although the fixed terminal 13 is biased by the spring force of the tension spring 25, the top end of the fixed terminal is never displaced downwards or slipped, thereby to always maintain the spring load constant, effecting stable switching operation.

Furthermore, since it is so arranged that the groove 32 is formed at opposite sides of the first base 11 during the assembling of the push-button switch, the LED terminal 31 can be easily assembled with stable size. Moreover, the insulation distance can be easily secured, and the number of component parts is reduced thereby to minimize the manufacturing cost of the switch.

Although the present invention has been fully described with reference to several preferred embodiments thereof, many modifications and variations thereof will now be apparent to those skilled in the art, and the scope of the present invention is therefore to be limited not by the details of the preferred embodiments described above, but only by the terms of the appended claims.

What is claimed is:

1. A push-button switch, comprising:

(A) a housing having a partition wall for dividing the interior of the housing into two side-by-side chambers;

(B) a switch mechanism for turning on and off an electric circuit said switch mechanism being disposed within one chamber of the housing;

(C) a push-button disposed within the other chamber of the housing and moved in response to a force applied from the exterior of the housing; and (D) an operating member that passes through a through hole in the partition wall for connecting the switch mechanism to the push-button and having a first end and a second end;

wherein said push-button comprises:

(a) a plunger for moving in response to said force and for contacting said first end of the operating member, and wherein the plunger slides along the partition wall which extends in a direction parallel to the direction of a force applied to the plunger and is disposed between the switch mechanism and the push-button;

(b) a coil for biasing the plunger in the opposite direction of the force;

and said switch mechanism comprises:

(a) a movable member having one end in engagement with the operating member and having a contact point on the other end;

(b) a spring for biasing the movable member against the operating member, wherein the force applied to the plunger and transmitted through the operating member to the movable member causes the contact point to move in a direction perpendicular to the direction of the force to thereby turn on the electric circuit, and wherein the through hole in the partition wall restricts downward motion of the operating member in order to maintain the movement of the contact point of the movable member in said perpendicular direction away from or toward a terminal contact for turning on the electric circuit.

2. The push-button switch of claim 1, wherein the operating member pivots around its second end, and wherein the biasing spring has at least one hooked end for engaging with the operating member and an opposing hooked end for engaging with the movable member on the end thereof having the contact point.

3. The push-button switch of claim 1 wherein the movable member is formed with a U-shaped notch so as to form two integral engagement pieces which are provided at the inner periphery thereof with engagement recesses opposed with each other and engaged with the outer edge of the operating member.

4. The push-button switch of claim 1 wherein said switch mechanism is provided with a fixed terminal formed in inverted L-shaped configuration, and a lateral frame integrally formed on a base to engage with the top end of the terminal.

5. The push-button switch of claim 1 further comprising:

(E) a base at the bottom of the housing having an insertion part formed on its top surface and a groove formed on its side surface;

(F) a luminator which inserts into the insertion part on the base; and (G) a terminal which inserts into the groove and which contacts the luminator.

6. The push-button switch of claim 5 wherein said luminator comprises (a) a lamp casing so provided in the upper part of the housing as to be able to be moved upward and downward, said switch mechanism being turned on and off by the application of pressure to the lamp casing, and (b) a light emitting element facing the inside of the lamp casing and provided at the upper position of the switch mechanism, said light emitting element being so provided to permit the up-and-down movement of the lamp casing through engagement thereof with the lamp casing.

7. The push-button switch of claim 5, wherein the luminator comprises:

(a) a light emitting diode mounted on the housing and which is actuated separately from the movement of the push-button, (b) a reflecting mirror having an axis and coupled to the push-button for reflecting the light from the light emitting diode, and wherein the reflecting mirror outwardly protrudes in a divergent manner from the light emitting diode; and (c) a lamp casing made of transparent material for supporting the light emitting diode at the axial center of the reflecting mirror and so arranged as to protrude to be exposed in the inside of the reflecting mirror through sliding movement of the reflecting mirror in response to the pressure application to the push-button.

* * * * *

UNITED STATES PATENT AND TRADEMARK OFFICE

CERTIFICATE OF CORRECTION

PATENT NO. : 4,851,623

DATED : July 25, 1989

INVENTOR(S) : Sueaki HONDA et al.

It is certified that error appears in the above-identified patent and that said Letters Patent is hereby corrected as shown below:

In item [75] on the cover sheet to this patent, change the name of "Akihiko Hayakawa" to --Tomohiko Hayakawa--.

Signed and Sealed this

Nineteenth Day of June, 1990

*Attest:*

HARRY F. MANBECK, JR.

*Attesting Officer*

*Commissioner of Patents and Trademarks*